United States Patent [19]

Yu

[11] Patent Number: 4,765,207

[45] Date of Patent: Aug. 23, 1988

[54] SCREW CAP OPENER

[76] Inventor: Wen C. Yu, 10318 Burgoyne, Houston, Tex. 77042

[21] Appl. No.: 54,223

[22] Filed: May 26, 1987

[51] Int. Cl.[4] ..... B67B 7/14

[52] U.S. Cl. ..... 81/3.42; 81/175; 81/164

[58] Field of Search ..... 81/3.42, 3.4, 3.33, 81/3.07, 3.37, 3.29, 129, 155, 157, 164, 175, 126, 127; 269/215, 247

[56] References Cited

U.S. PATENT DOCUMENTS

| | | | |
|---|---|---|---|
| 584,180 | 6/1897 | Levendusky | 81/175 |
| 899,683 | 9/1908 | Sarvalla et al. | 81/3.42 |
| 1,075,649 | 10/1913 | Hill | 81/175 |
| 2,516,395 | 7/1950 | Kerr | 81/175 X |
| 2,749,784 | 6/1956 | Hrebicek | 81/3.42 |
| 4,052,917 | 10/1977 | Gee | 81/3.42 |

*Primary Examiner*—Debra Meislin

[57] ABSTRACT

A screw cap removing and tightening device comprises: an elongate plate member formed to provide a front gripping member at its front end, a plurality of longitudinally equal spaced teeth members in the intermediate portion, a cylindrical channel member at its rear end, and a slightly slopped downward member connecting the intermediate portion and the rear end; surrounding means which substantially surrounds the intermediate portion of the elongate plate member and is slidably movable along the elongate plate member; locking means movably secured to the surrounding means for preventing a rearward movement of the surrounding means; a rear gripping member supported and confined by the surrounding means; and rotating and twisting means contained by the cylindrical channel member and engaged with the surrounding means. The rotating and twisting means may be rotated to control precisely the tightness of the contact between the gripping members and the cap and then, twisted to tighten or remove the cap from a container.

5 Claims, 2 Drawing Sheets

SCREW CAP OPENER

BACKGROUND OF THE INVENTION

The present invention relates to improvements in devices for tightening and removing screw caps from containers, and more particularly to a manually-operated screw cap removing and tightening device which is easy to control and manipulate.

SUMMARY OF THE INVENTION

The primary object of the present invention is to provide a simple manually-operated screw cap removing and tightening device which may be applied to caps varying greatly in diameter and requires no assistance of any fixture.

Another object is to provide such a device of the class above described which is easy to control the tightness of the contact between the gripping members of such a device and the cap.

Still another object is to provide such a device of the class above described which requires a minimum effort to remove or tighten the cap.

Further objects and advantages of the present invention will become apparent from a consideration of the drawings and ensuing description thereof.

BRIEF DESCRIPTION OF THE DRAWINGS

The present invention will now be explained with reference to the accompanying drawings, in which.

PREFERRED EMBODIMENT OF THE INVENTION

In describing the invention the terms "rotated" and "rotating" refer to a rotation of a cylindrical bar around its longitudinal axis; "twisted" and "twisting" refer to a twisting of a cylindrical bar around the circumference of the cap to be removed or tightened.

Figure 1:
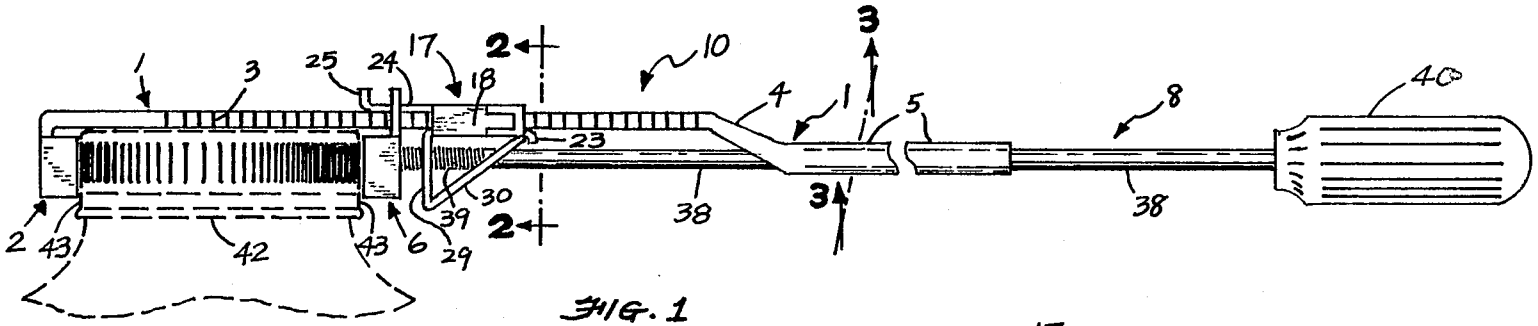
FIG. 1 is a perspective view of the screw cap removing and tightening device accordiing to the present invention.

Referring to the drawings, in particular FIG. 1, a screw cap removing and tightening device 10 according to the present invention includes: an elongate plate member 1 formed to provide: a front gripping member 2 at its front end, a plurality of longitudinally equal spaced teeth members 3 projected laterally along one of its side edges in the intermediate portion, a cylindrical channel member 5 at its rear end, and a slightly slopped downward member 4 connecting the intermediate portion and the rear end; a rear gripping member 6; rotating and twisting means 8 including a cylindrical bar 38 with a threaded portion 39 at its front end and a handle 40 secured to its rear end; surrounding means 17 including a front end portion 24 to support and confine the rear gripping member 6, a vertical support portion 29 to engage with the threaded portion 39 of the cylindrical bar 38, a slopped support portion 30, and locking means 18 which may be engaged with a given one of the teeth members 3.

Figure 2:
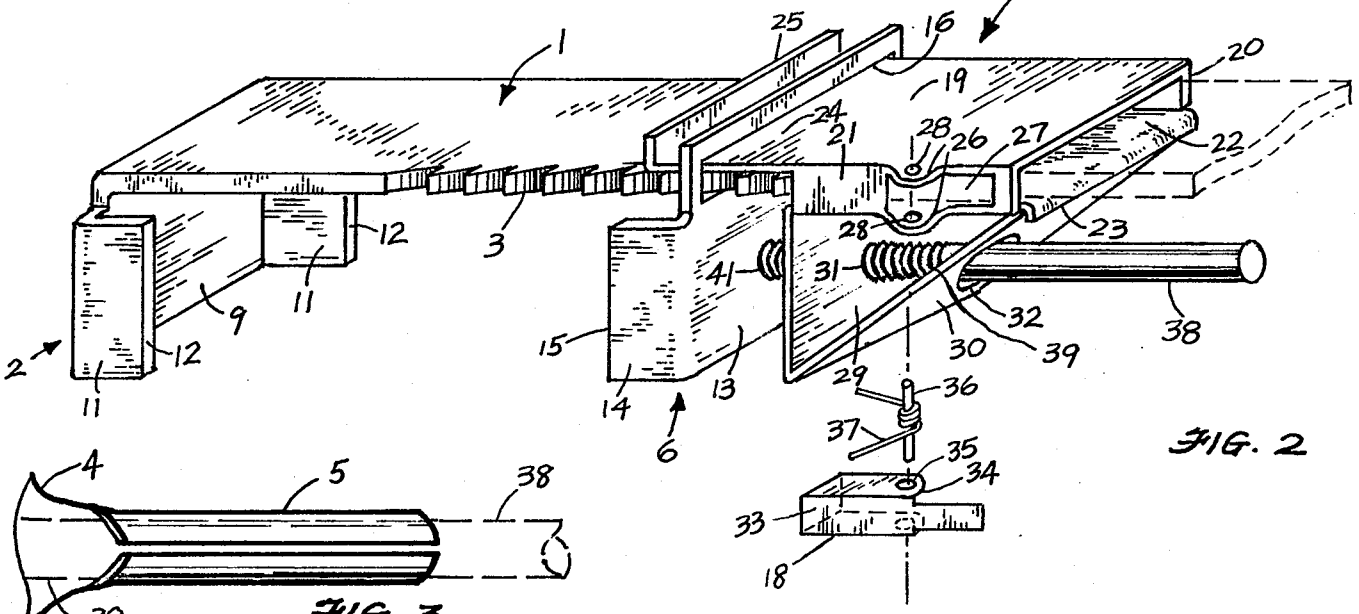
FIG. 2 is a sectional view of such a device taken from the line 2—2 in FIG. 1.
Figure 3:
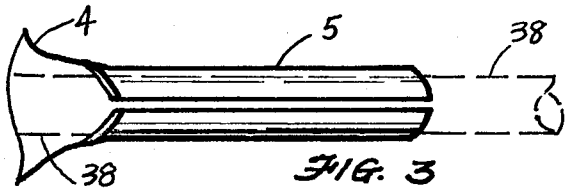
FIG. 3 is a bottom sectional view of such a device taken from the line 3—3 in FIG. 1.

Referring now to FIGS. 1, 2, and 3, the front end of the elongate plate member 1 extends downwardly to form a front gripping member 2 having a pair of laterally spaced gripping portions 11 connected by a web portion 9. The teeth members 3 are formed in such a manner to facilitate preventing a rearward movement of the surrounding means 17 when engaged with the locking means 18. The slightly slopped downward member 4 is formed so as to permit the front extremities 41 of the cylindrical bar 38 to be in contact with a strategic portion of the rear gripping member 6. The cylindrical channel member 5 is formed to contain the cylindrical bar 38 and permit the same to be slidably moved longitudinally.

The surrounding means 17 substantially surrounded the intermediate portion of the elongate plate member 1 includes a top portion 19, two lateral side portions 20, 21 and a bottom portion 22. The top portion extends forwardly to form a front end portion 24 and a front guard 25 at its front edge. The front end portion 24 is to support the rear gripping member 6 and to limit the same to be slidably moved longitudinally within the front end portion 24. The rear end of the bottom 22 portion extends downwardly to form a rear guard 23. The front end of the bottom portion 22 extends first downwardly and then, slopped upwardly to form a vertical support portion 29 parallel to the web portion 9 and a slopped support portion 30 with its terminal end being in firm contact with the inside corner of the rear guard 23. The vertical support portion 29 has a threaded circular opening 31 which meshes with the threaded portion 39 of the cylindrical bar 38. The slopped support portion 30 is provided with an opening 32 for cylindrical bar 38 to be moved freely. The opening 31 and the cylindrical channel member 5 have a common center projected longitudinally. The side portion 21 is provided with an opening 27 for the strategic portion of the locking means to move in or out of the side portion 21 without any interference to engage with a given one of the teeth members 3, and two arm members 26 extended outwardly from the top and bottom portions 19, 22.

Figure 4:
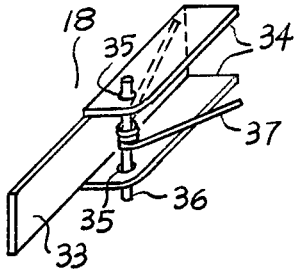
FIG. 4 is a perspective view of the locking means.
Figure 5:
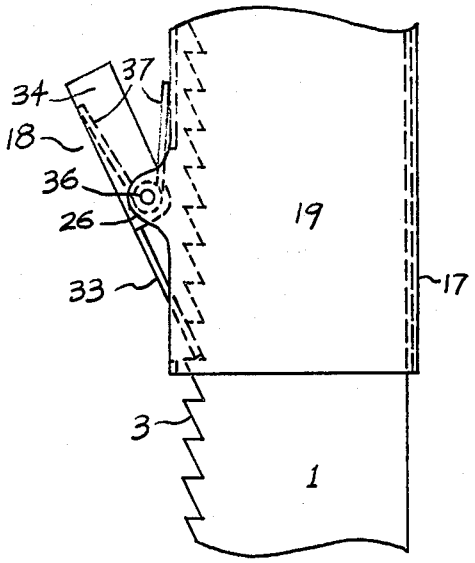
FIG. 5 is a top sectional view of the surrounding means and the elongate plate member showing the locking means engaging with one of the teeth members.

Referring to FIGS. 3, 4, and 5 the locking means 18 is movably secured to the arm members 26 of the side portion 21 of the surrounding means 17 by a shaft member 36 rotatably received in the openings 28, 35. A spring member 37 is mounted between the inner space bounded by the top and side portions 33, 34 of the locking means 18 and the outer wall of the side portion 21 of the surrounding means 17. When the spring member 37 is in its natural relax state, the rear end of the top portion 33 is engaged with a given one of the teeth members 3 of the elongate plate member 1. Applying a pressure to the front end of the top portion 33 causes the rear end of the top portion 33 to disengage from a given one of the teeth members 3 and thereby allows the surrounding means 17 to be moved in either forward or rearward direction along the elongate plate member 1.

A rear gripping member 6 includes a pair of laterally spaced gripping portions 14 connected by a web portion 13 with an opening 16 near its top edge. The opening 16 of the rear gripping member 6 is to contain the front end portion 24 of the surrounding means 17 and the intermediate portion of the elongate plate member 1. With the rear gripping member 6 being supported by the front end portion 24 of the surrounding means 17, the gripping surfaces 12, 15 of the front and rear gripping members 2, 6 are facing each other longitudinally.

In use, the rotating and twisting means 8 is first rotated clockwisely or counter-clockwisely such that its front extremity 41 passes slightly the vertical support portion 29. By pressing the locking means 18, the surrounding means 17 together with the rear gripping member 6 and the rotating and twisting means 8 are moved to a longitudinal position which defines a space between the front and rear gripping surfaces 12, 15 being larger than the cap 42 to be removed or tightened. The cap 42 is then allowed to enter the space above described with the front and rear gripping member 2, 6 being at the diametrically opposite sides of the cap 42. The rotating and twisting means 8 is then pushed forwardly to permit the front and rear gripping surfaces 12, 15 contact with the rim of the cap 42 while holding the cylindrical channel member 5. The top portion of the rear gripping means 6 is now at a position substantially away from the front guard 25 of the surrounding means 17. The rotating and twisting means 8 is rotated clockwisely as required to force the locking means 18 firmly engaged with one of the teeth members 3 and to tighten the contact between the gripping surfaces 12, 15 and the rim 43 of the cap 42. Finally, the rotating and twisting means 8 is twisted clockwisely or counter-clockwisely to tighten or remove the cap 42 from a container.

While the above description contains many specificities, these should not be construed as limitations on the scope of the present invention, but rather as an exemplification of one preferred embodiment thereof. Many other variations are possible, for example, the gripping surfaces 12, 15 may take the form of surfaces with mutliple teeth; the slopped support portion 30 and rear guard 23 may be eliminated by using only a rather strong vertical support portion 29 with a thicker material. Accordingly, the scope of the invention should be determined not by the emobodiment illustrated, but by the appended claims and their legal equivalents.

What I claim is:

1. A screw cap removing and tightening device comprising:

a. an elongate plate member having a front gripping member at its front end having a pair of laterally spaced gripping portions connected by a web portion, a cylindrical channel member at its rear end, and an intermediate portion connecting its front end and the cylindrical channel member, at least one side of the intermediate portion having longitudinally equal spaced teeth members, b. surrounding means substantially surrounding the intermediate portion of the elongate plate member and being slidably movable along the intermediate portion of the elongate plate member, the surrounding means having a depending front end portion extended forwardly from its top portion, and a depending support portion extended downwardly from its bottom portion, the front end portion having a front guard at its front edge, and the support portion having a threaded circular opening, c. locking means secured to the surrounding means for selectively engaging with one of the teeth members to prevent a rearward sliding movement of the surrounding means, or disengaging from one of the teeth members to allow the surrounding means to be moved freely, d. a rear gripping member having a pair of laterally spaced gripping portions connected by a web portion, the rear gripping member being movably supported by the front end portion of the surrounding means and movably confined by the front guard and the support portion of the surrounding means, e. rotating and twisting means having a cylindrical bar with a threaded portion at its front end, and a handle secured to its rear end, the threaded portion being rotatably engaged with the threaded circular opening of the support portion of the surrounding means, and the cylindrical bar being movably confined within the cylindrical channel member of the elongate plate member.

2. The invention defined in claim 1 wherein the teeth members of the elongate plate member are formed to facilitate preventing a rearward sliding movement of the surrounding means when engaged with the locking means.

3. The invention defined in claim 1 wherein the threaded circular opening of the support portion of the surrounding means and the cylindrical channel member of the elongate plate member are longitudinally concentric.

4. The invention defined in claim 1 wherein the gripping surfaces of the gripping portions of the front and rear gripping members are facing each other longitudinally.

5. The invention defined in claim 1 wherein the intermediate portion of the elongate plate member is bent downwardly at its rear portion to permit the front end of the cylindrical bar of the rotating and twisting means to be in contact with the web portion of the rear gripping member and horizontally in alignment with the rim of the cap to be removed or tighten.

* * * * *